US009796937B2

(12) United States Patent
Fanget et al.

(10) Patent No.: US 9,796,937 B2
(45) Date of Patent: Oct. 24, 2017

(54) PROCESS FOR THE PRODUCTION OF LIGHT OLEFINS AND BTX USING A CATALYTIC CRACKING UNIT, NCC, PROCESSING A NAPHTHA TYPE FEED, A CATALYTIC REFORMING UNIT AND AN AROMATICS COMPLEX

(71) Applicant: IFP Energies Nouvelles, Rueil-Malmaison (FR)

(72) Inventors: Bertrand Fanget, Vienne (FR); Abdelhakim Koudil, Lyons (FR); Romain Corroyer, Grigny (FR); Alexandre Pagot, St Genis Laval (FR); Joana Fernandes, Solaize (FR)

(73) Assignee: IFP Energies Nouvelles, Rueil-Malmaison (FR)

( * ) Notice: Subject to any disclaimer, the term of this patent is extended or adjusted under 35 U.S.C. 154(b) by 333 days.

(21) Appl. No.: 14/679,075

(22) Filed: Apr. 6, 2015

(65) Prior Publication Data

US 2015/0284646 A1 Oct. 8, 2015

(30) Foreign Application Priority Data

Apr. 7, 2014 (FR) ..... 14 53076

(51) Int. Cl.

| | |
|---|---|
| ***C10G 69/08*** | (2006.01) |
| ***C10G 35/00*** | (2006.01) |
| ***C10G 63/04*** | (2006.01) |
| ***C10G 63/08*** | (2006.01) |
| ***C10G 11/18*** | (2006.01) |

(52) U.S. Cl.
CPC ..... *C10G 69/08* (2013.01); *C10G 11/18* (2013.01); *C10G 35/00* (2013.01); *C10G 63/04* (2013.01); *C10G 63/08* (2013.01)

(58) Field of Classification Search
None
See application file for complete search history.

(56) References Cited

U.S. PATENT DOCUMENTS

| | | | | |
|---|---|---|---|---|
| 5,414,172 | A * | 5/1995 | Chin | C10G 59/02 208/100 |
| 6,004,452 | A | 12/1999 | Ash et al. | |
| 7,491,315 | B2 | 2/2009 | Eng et al. | |
| 2006/0260981 | A1 * | 11/2006 | Gosling | C10G 11/05 208/59 |
| 2008/0035527 | A1 | 2/2008 | Eng et al. | |

(Continued)

OTHER PUBLICATIONS

Search Report and Opinion from corresponding French Patent Application No. 14/53076 dated Dec. 8, 2014.

*Primary Examiner* — Tam M Nguyen
(74) *Attorney, Agent, or Firm* — Millen White Zelano & Branigan, P.C.

(57) ABSTRACT

The present invention concerns a process for the production of light olefins and BTX using a catalytic cracking unit, NCC, processing a naphtha type feed, and an aromatics complex. It can be used to exploit the synergies between these two units. The thermal balance of the NCC, which is intrinsically deficient in coke, is resolved by the optimal use of heat from the reforming furnaces in order to preheat the feed for the NCC, and by introducing at least a portion of the raffinate obtained from the aromatics complex as a mixture with the naphtha.

9 Claims, 4 Drawing Sheets

(56) References Cited

U.S. PATENT DOCUMENTS

2013/0296623 A1* 11/2013 Iaccino ..... C07C 2/64
585/321
2015/0299593 A1* 10/2015 Kalnes ..... C10G 63/00
585/304

* cited by examiner

PROCESS FOR THE PRODUCTION OF LIGHT OLEFINS AND BTX USING A CATALYTIC CRACKING UNIT, NCC, PROCESSING A NAPHTHA TYPE FEED, A CATALYTIC REFORMING UNIT AND AN AROMATICS COMPLEX

FIELD OF THE INVENTION

The interest in cracking paraffinic straight run type gasoline feeds in FCC units in order to upgrade them to propylene and ethylene is relatively recent. This interest derives from the necessity for the provision of light olefins, ethylene and propylene for petrochemistry, in addition to the traditional source constituted by steam cracking. Cracking of a gasoline or naphtha type cut leads to a modification of the operating conditions for FCC and the use of a ZSM-5 type zeolite. Currently, the market price differential between light olefins and gasoline is motivation to improving the margins made from gasoline by transforming it into these light olefins. In addition, improvements in zeolitic catalysts have resulted in more interesting yields in this transformation of light olefins.

The current term for this new type of FCC unit is NCC, for "Naphtha Catalytic Cracking".

In addition to producing olefins, cracking reactions are accompanied by the formation of aromatic molecules which in themselves have generally not been upgraded because the cost of separating them proved to be of little or no benefit.

Further, cracking light cuts in the FCC process poses a problem, because this type of feed does not produce sufficient coke under FCC conditions, and thermal balance of the FCC can only be obtained by adding external heat to the process.

The present invention proposes an original solution for overcoming this problem by exchanging streams with the aromatics complex.

Examination of the Prior Art

Documents which propose recycling cuts with a high coke potential of the "slurry" type to the regenerator of a catalytic cracking (FCC) unit can readily be found.

Other documents describe recycling the coking cut to the stripper of the FCC or to a chamber which is associated with the stripper. The invention proposes recycling a coking cut obtained from the aromatics complex itself to the reactor of the NCC unit. A non-aromatic raffinate is also recycled to the reactor of the NCC unit in order to increase the production of light olefins.

In summary, catalytic cracking of a naphtha type cut can be used to increase the yields of light olefins compared with a FCC unit operating on conventional feeds and the problem of cycling the thermal balance of the NCC is overcome by using a heavy aromatics cut obtained from the aromatics complex.

BRIEF DESCRIPTION OF THE INVENTION

Figure 1:
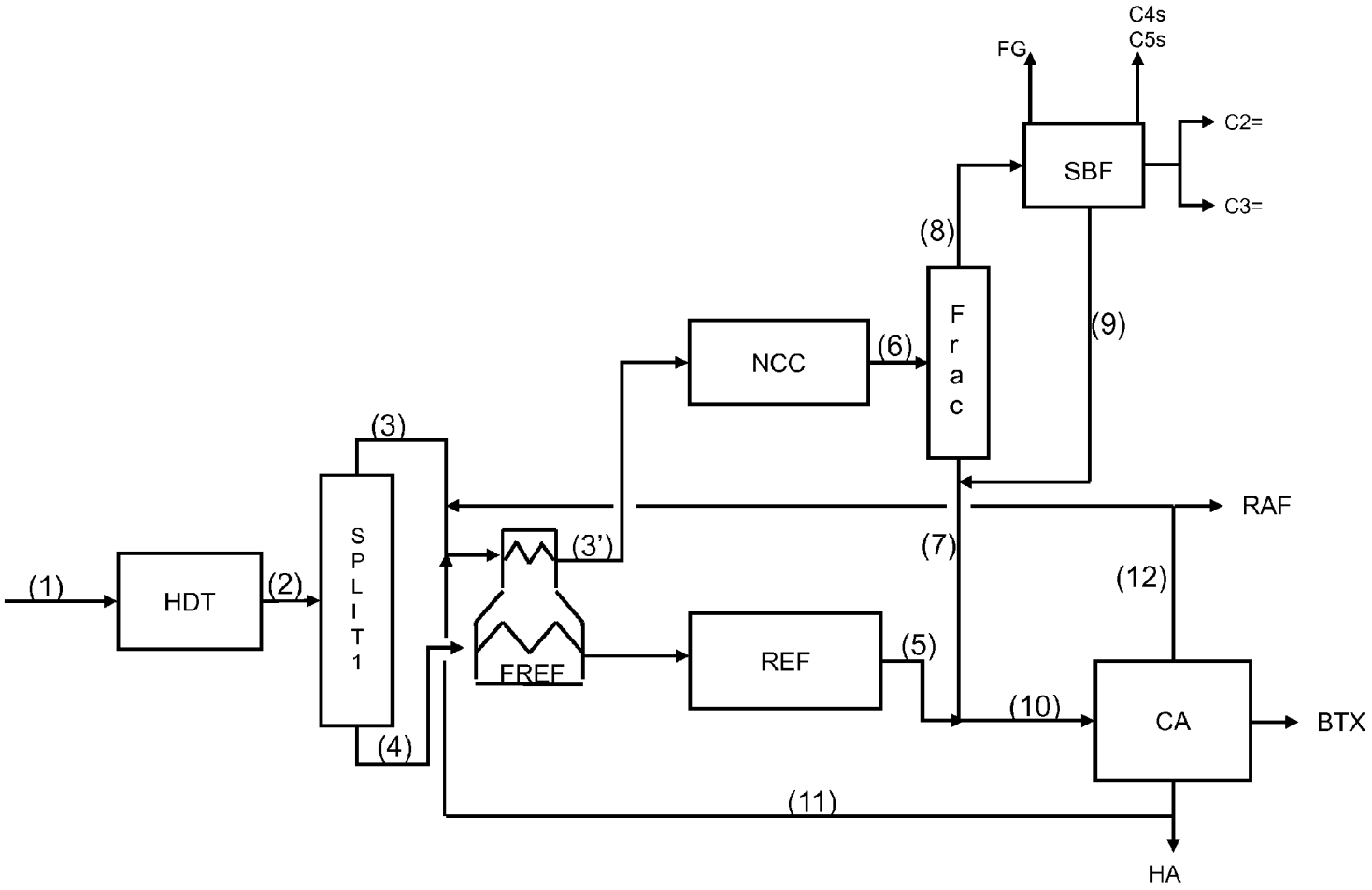
FIG. 1 represents the layout of the process of the invention in its basic version. In this version, at least a portion of the raffinate obtained from the aromatics complex (CA) is sent directly as a mixture with the light naphtha obtained from the separation unit SPLIT1 placed upstream of the NCC in order to supply the NCC unit. The fractionation unit placed upstream of the NCC unit and denoted SPLIT1 can be used to separate the starting naphtha cut into a light fraction termed the "light naphtha" which is supplied to the NCC and a heavy fraction termed the "heavy naphtha" which is supplied to the catalytic reforming unit.

The present invention describes a layout for a refining and petrochemistry process which integrates three units: the FCC, processing a light naphtha type feed, termed NCC, the catalytic reforming which processes heavy naphtha, and the aromatics complex AC, which produces BTX.

These three units are integrated both by means of exchanging material streams and also by using the convection zone of the reforming furnaces to pre-heat the naphtha feed of the NCC.

The advantages of integrating the NCC unit and the aromatics complex AC may be summarized in the following points:

The simultaneous production of light olefins and aromatics starting from an initial naphtha feed.

The NCC unit benefits from the proximity of a high coking feed in order to compensate for the deficit of coke in the light naphtha feed, and from a surplus of feed in the form of raffinate originating from the aromatics complex, to produce more light olefins.

Integrating the NCC with the aromatics complex means that a process layout can be obtained which in the end reduces emissions of fuel gas (essentially $H_2$ and $C_1$), light olefins ($C_2$= and $C_3$=) and BTX.

Recycling the other effluents to exhaustion, for example the raffinate and the heavy aromatics fraction obtained from the aromatics complex (CA), means that both the production of light olefins, ethylene and propylene, can be increased and also the thermal balance of the NCC can be ensured. For this reason, it is possible to speak of a true synergy between the NCC and the aromatics complex.

The "heavy aromatics" stream from the aromatics complex AC is thus reduced as far as possible or even eliminated, to the benefit of the coke produced during the catalytic cracking reaction, and burned in the NCC regenerator in order to reach thermal balance.

The stream of raffinate 12 from the aromatics complex is also reduced as far as possible or even eliminated, to the benefit of the light olefins produced by cracking in the NCC.

The feed for the NCC is preheated by the furnaces of the catalytic reforming unit FREF, preferably in the convection zone thereof, which means that the thermal balance of the coke-deficient NCC can be better equilibrated.

More precisely, the present invention describes a process layout which allows the simultaneous production of light olefins (principally ethylene and propylene) and BTX, calling upon three units functioning in a synergistic manner: a FCC unit processing a light naphtha type feed termed NCC, a unit REF for catalytic reforming of the heavy naphtha cut, and an aromatics complex (CA) producing BTX.

The layout of the process of the present invention can be described as follows:

The feed for the process is a naphtha cut which, in its broadest definition, is that of a cut with an initial boiling point of at least 30° C. and an end point of at most 220° C. Any cut with a distillation range within the broad range of 30° C.-220° C. is considered to constitute a naphtha in the context of the present invention.

For simplicity, 30° C. and 220° C. will be considered to be the typical initial and end points for a naphtha cut.

The naphtha feed 1 with a distillation range of 30° C.-220° C. is sent to a hydrotreatment unit HDT which can be used to eliminate the sulphur-containing and nitrogen-containing compounds it contains.

The hydrotreated naphtha feed 2 is sent to a separation unit SPLIT1 which can be used to separate a light fraction termed light naphtha, with a distillation range of 30° C.-$T_M$° C., and a heavy fraction termed heavy naphtha, with a distillation range of $T_M$° C.-220° C.

The value of the cut point $T_M$° C. may vary as a function of the desired yields of the final products (ethylene and propylene and BTX).

In general, the temperature $T_M$ is in the range 80° C. to 160° C., and preferably in the range 100° C. to 150° C., and still more preferably in the range 110° C. to 140° C.

The light naphtha 3 is sent as a feed for the NCC.

The heavy naphtha 4 is sent as a feed for the catalytic reforming unit REF.

The effluents 6 from the NCC are separated in a fractionation unit FRAC which can be used to separate a light fraction 8 which is sent to a separation unit termed the cold box, CBS, which can be used to isolate $H_2$, $CH_4$ and $C_2$, $C_3$, $C_4$, $C_5$ light paraffins, and ethylene, $C_2$=, and propylene, $C_3$=.

The heavy fraction 7 obtained from the separator FRAC is sent, as a mixture with the effluents 5 from the catalytic reforming REF, as a feed 10 for the aromatics complex (CA).

The aromatics complex (CA) can be used to extract BTX, a raffinate 12 corresponding to the non-aromatic portion of the effluents, at least a portion of which is sent as a mixture with the light naphtha 3 as a feed for the NCC, and a fraction termed the heavy aromatics 11 which is also sent as a mixture with the light naphtha 3 as a feed for the NCC, in order to obtain thermal balance thereof due to its coking power.

Figure 2:
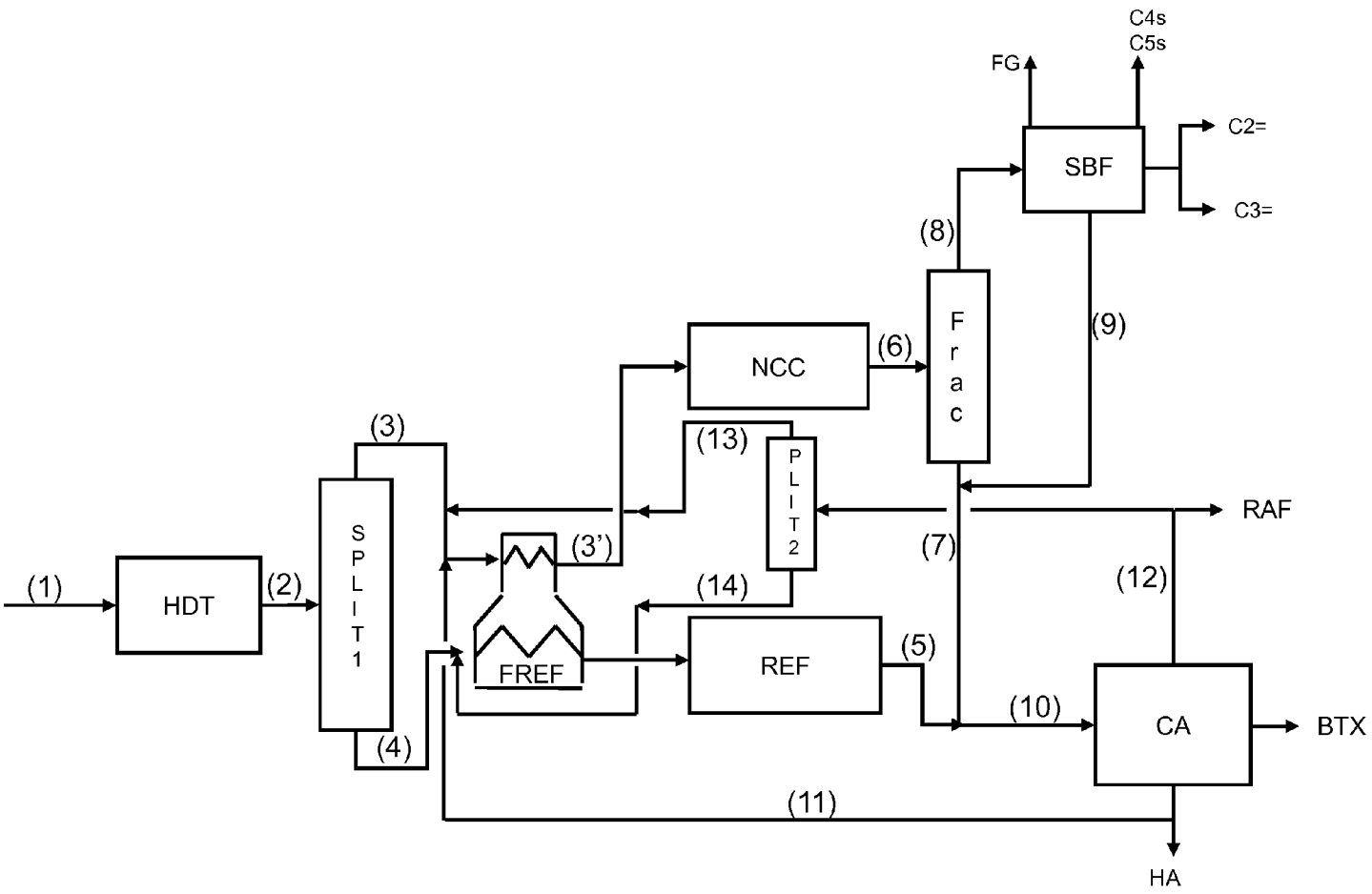
FIG. 2 represents a first variation of the layout of the process of the present invention, in which the raffinate obtained from the aromatics complex is sent to a separation column SPLIT2 which can be used to separate a first, lighter raffinate (stream 13) which is introduced as a mixture with the light naphtha feed for the NCC unit, and a heavier, second raffinate (stream 14) which is directed to the catalytic reforming unit.

In a first variation of the process of the invention, shown in FIG. 2, the raffinate effluent 12 from the aromatics complex (CA) is sent to a separation unit SPLIT2 which can be used to separate a light fraction 13 which is sent, as a mixture with the light naphtha feed 3, to the catalytic cracking unit NCC, and a heavy fraction 14 which is sent, as a mixture with the heavy naphtha feed 4, to the catalytic reforming unit REF.

Figure 3:
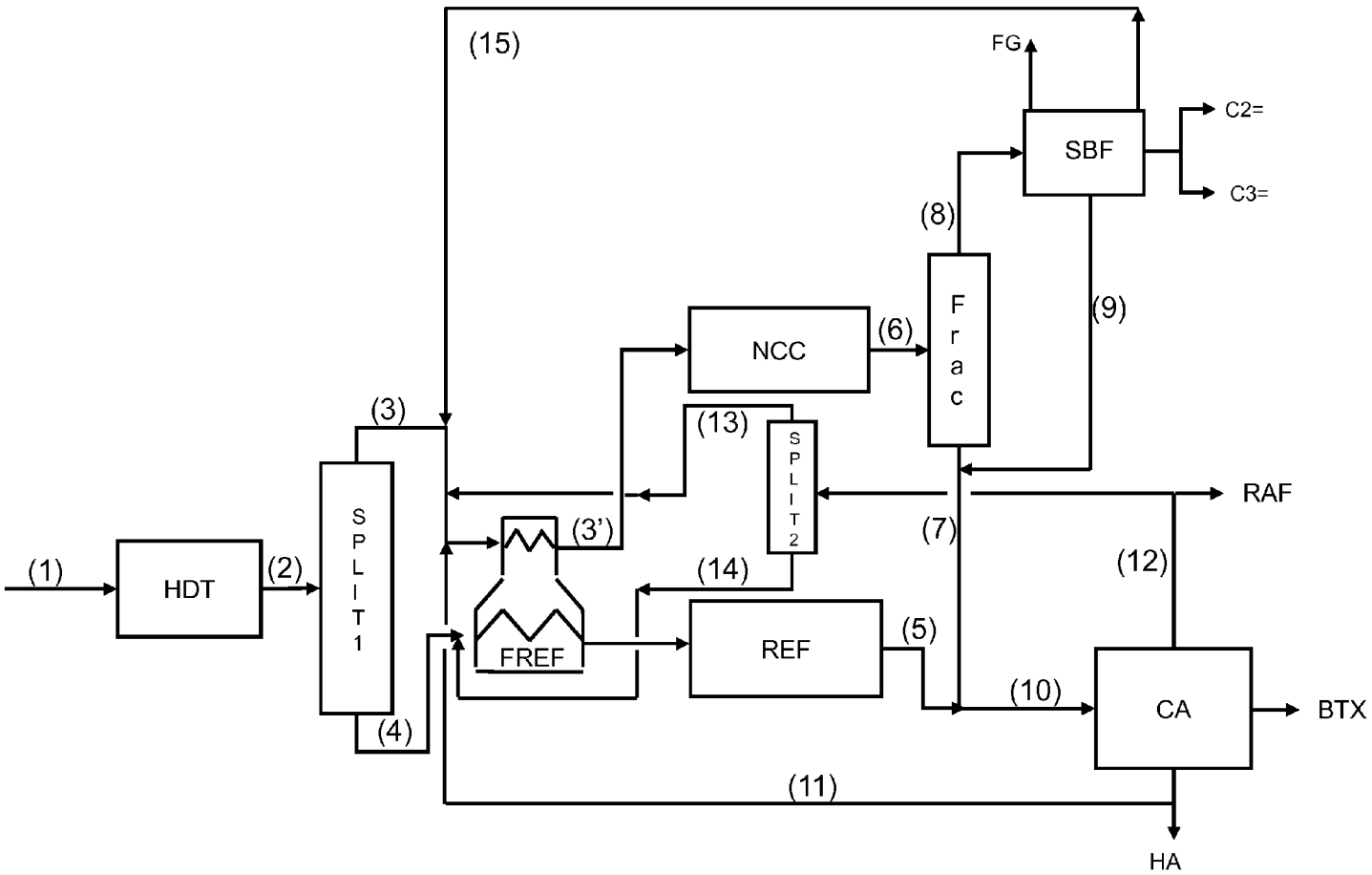
FIG. 3 represents a second variation of the layout of the process of the invention which, in addition to the modification of the first variation, introduces a recycle of light ethane, propane and butane type paraffinic hydrocarbons mixed with the light naphtha feed from the NCC (stream 15).

In a second variation of the process of the invention shown in FIG. 3, which variation may be combined with the first variation, the light $C_2$ to $C_5$ paraffins produced as effluents from the catalytic cracking unit NCC originating from the separation box CBS are sent to the catalytic cracking unit NCC as a mixture with the light naphtha feed 3 in order to increase the yield of light olefins, ethylene and propylene and to improve transport and fluidization.

Figure 4:
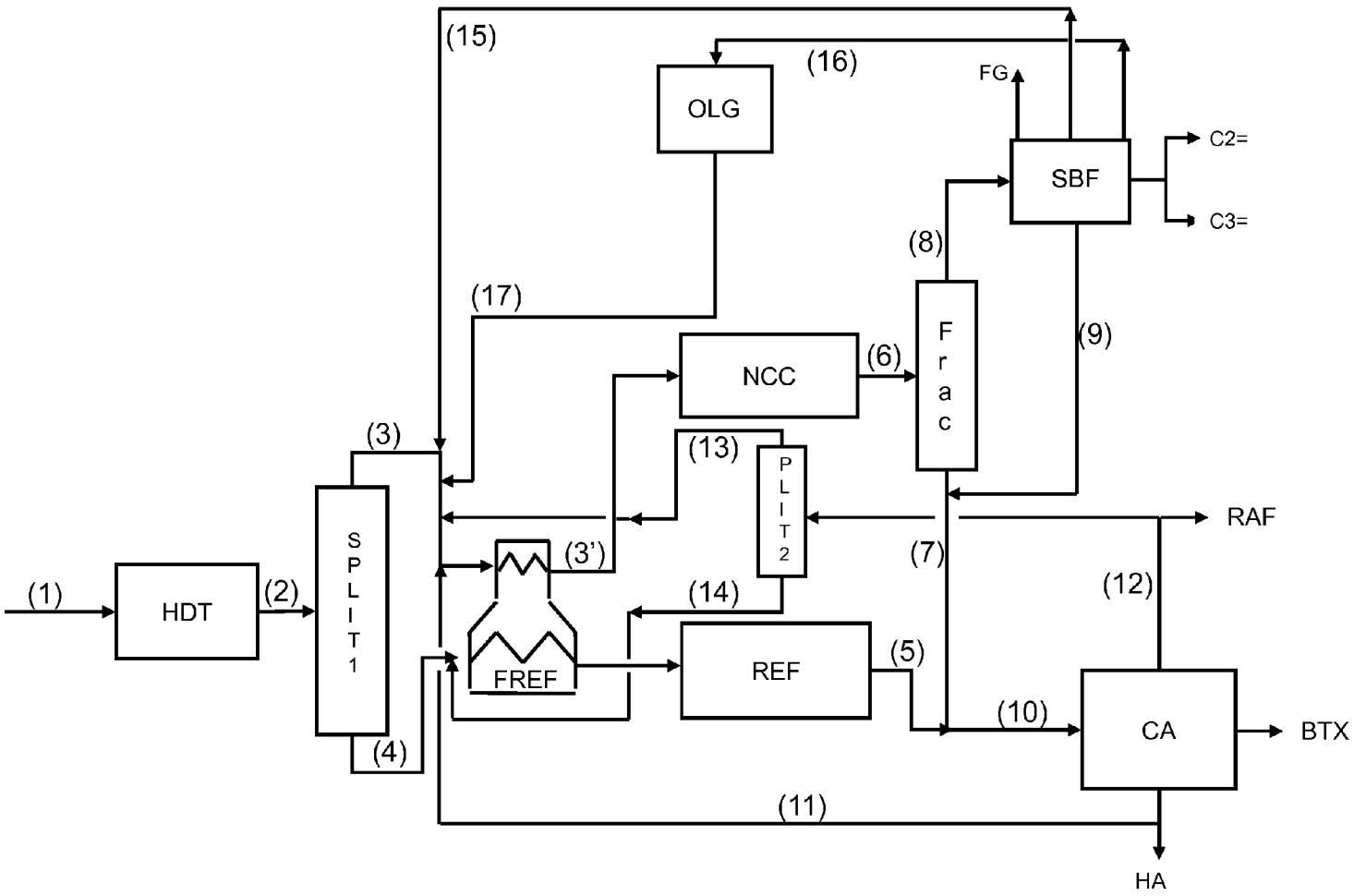
FIG. 4 represents a third variation of the layout of the process of the invention which, in addition to the units already present in the preceding variations, introduces a unit OLG for oligomerization of the $C_4$ and $C_5$ cuts in order to produce oligomers which are easier to crack and capable of producing even more propylene and ethylene.

In a third variation of the process of the invention shown in FIG. 4, which variation may be readily combined with the preceding variations, the light $C_4$ and $C_5$ molecules obtained are sent from the separation box CBS to an oligomerization unit OLG and the effluents from said oligomerization unit OLG are sent to the catalytic cracking unit NCC as a mixture with the light naphtha feed 3.

Finally, in all of the variations of the process of the present invention, the light naphtha cut 3 obtained from the fractionation SPLIT1 is preferably preheated in the convection zone of the catalytic reforming furnaces (FREE) before being introduced as the feed for the catalytic cracking unit NCC.

The process for the production of light olefins and BTX of the present invention preferably involves operating the NCC unit under severe cracking conditions, i.e. a reactor outlet temperature, ROT, in the range 500° C. to 750° C., and a ratio of the mass flow rate of catalyst to the mass flow rate of feed (C/O) in the range 5 to 40.

The process for the production of light olefins and BTX of the present invention uses, for the NCC unit, a catalyst comprising a proportion of zeolite which is at least equal to 20%, and more particularly a proportion of ZSM-5 zeolite at least equal to 10% by weight with respect to the total catalyst.

DETAILED DESCRIPTION OF THE INVENTION

A FCC unit generally processes a heavy cut obtained from the vacuum distillation unit such as VGO (Vacuum Gas Oil), or a vacuum residue, used alone or as a mixture, or an atmospheric residue, used alone or as a mixture.

However, the feed arriving at the FCC may be lighter because of a prior pre-treatment of the VGO, for example, or because it originates from a conversion unit in which the initial feed is enriched in hydrogen and from which certain impurities have been removed.

A recent adaptation of to still lighter gasoline type feeds, also known as naphtha, is intended to convert these streams into light olefins (ethylene and propylene) produced with a high added value and constitute starting points for the petrochemicals market.

A FCC unit processing naphtha type feeds is then termed a NCC, The major problem with cracking these naphtha type feeds arises from the low coke yield of the feed, which means that the thermal balance of the unit has to be reconsidered.

In the present invention, this problem of the thermal balance of the NCC is resolved by a synergy with an aromatics complex, (CA)

FIG. 1 diagrammatically shows the aromatics complex with an integrated NCC unit; this constitutes the subject matter of the invention.

The naphtha feed is a gasoline cut the initial boiling point of which is 30' C or higher, and the end point of which is generally 220° C. or lower. It is pre-treated in a hydrotreatment unit, HDT, in order to free it from sulphur-containing and nitrogen-containing compounds which are capable of poisoning the downstream catalysts.

The desulphurized/denitrogenated naphtha effluent is sent to a fractionation unit SPLIT1. The light portion obtained from this fractionation (stream 3) is sent to the NCC unit, while the heavy portion (stream 4) is sent to the catalytic reforming unit, REF, after having been heated to the desired level in a reforming oven FREF.

Fractionation of the downstream NCC unit is represented by the unit FRAC and can be adjusted so as to orientate the production towards lighter olefins or even towards aromatics.

The heavy stream 7 leaving the fractionation unit FRAC is directed towards the aromatics complex (CA).

The light stream 8 leaving the fractionation unit FRAC is directed towards a separation unit CBS to separate the light olefins ethylene and propylene, hydrogen and methane, and propane and butane.

The heavy stream 7 obtained from fractionation, FRAC, is mixed with effluents from the catalytic reforming unit 5 in order to form the feed 10 for the aromatics complex AC from which BTX compounds are withdrawn, and a heavier aromatic cut corresponding to the stream 11.

The non-aromatic cut known as the raffinate corresponds to stream 12 and, in the basic version of the layout of the invention, is sent as a feed for the NCC unit as a mixture with the light naphtha fraction 3.

The units employed in the present layout, i.e. the NCC, the catalytic reforming unit REF and the aromatics complex (AC), can be used to produce ethylene and propylene, and BTX compounds, from the starting naphtha. Certain variations of the basic layout can be used to produce more propylene or ethylene.

The aromatics complex (CA) can be used to produce benzene, toluene and xylenes (generally denoted BTX), and in particular para-xylene, a basic product for petrochemistry. At least a portion of the stream of heavy aromatics, stream 11, is recycled to the NCC as an additional feed, as a mixture with the light naphtha feed 3, and can be used to provide the thermal balance of the NCC.

The stream termed the raffinate 12, corresponding to the non-aromatic portion of the aromatics complex (CA), is recycled at least in part to the NCC as an additional feed producing light olefins.

In accordance with the layout represented in FIG. 2, the raffinate 12 may be separated into two fractions in a separation unit denoted SPLIT2, the light portion 13 going to the NCC essentially to produce olefins and a few aromatics, and the heavy portion 14 going for reforming, REF, to produce supplemental aromatics.

After separation in the fractionation unit FRAC and cold box CBS, the NCC unit produces a $C_6$+ stream (denoted 9) containing an appreciable quantity of aromatics which are introduced as a mixture with the heavy fraction from the fractionation, FRAC, to form the stream 7 supplying the aromatics complex (CA) as a mixture with the effluents 10 from the catalytic reforming unit REF.

The non-aromatic fraction of the effluents from the aromatics complex AC, termed the raffinate (stream 12) is returned to the NCC, partially or in its entirety, forming an additional feed to the principal feed 3 for the NCC. This additional feed can be used to increase the final yields of light olefins $C_2$= and $C_3$=.

The products from NCC other than ethylene or propylene may be recycled to this same unit. It is also possible to use the portion termed dry gas, which excludes ethylene, and the portion known as LPG, which excludes propylene, as a fuel gas in the catalytic reforming furnaces FREF.

FIG. 3 considers another variation in which the $C_2$ and $C_3$ paraffins as well as the $C_4$ and $C_5$ cuts obtained from the cold box separation, CBS, are recycled to the NCC as a mixture or separately.

Another manner of recycling the $C_4$ and $C_5$ cuts obtained from NCC is to first pass through an oligomerization unit OLG in order to produce oligomers which are easier to crack, and which are capable of producing even more propylene and ethylene. This variation is illustrated in FIG. 4.

In all of the layouts, the heat exchange train of the reforming unit is exploited to increase the temperature of the light naphtha 3 going to the NCC unit. This preheating of the NCC feed means that the heat required for thermal balancing of the NCC is gained.

The thermal balance of the NCC is ensured by recycling the heavy aromatics cut HA, denoted 11, leaving the aromatics complex (CA). This heavy aromatics cut can be defined as forming compounds containing more than 8 carbon atoms. This highly aromatic cut is a high coking cut which can be used to generate the quantity of coke necessary for cycling the thermal balance of the NCC unit.

The NCC unit is a naphtha catalytic cracking unit, NCC, having at least one principal reactor operating either in upflow mode (riser) or in downflow mode (downer).

In the text below, the term "reactor" will be used without specifying the type of flow, since the present invention encompasses both possible modes of flow. Alternatively, the NCC unit may be provided with a secondary reactor of the riser or downer type in order to crack recycles or additional streams separately.

It has a separation-stripping section in which the catalyst is separated from the hydrocarbon effluents.

It also has a catalyst regeneration section in which the coke formed in the reaction and deposited on the catalyst is burned in order to recover a portion of the heat necessary for the reactor in the form of sensible heat of the catalyst.

The NCC unit has its own section for treatment of hydrocarbon effluents, in particular with a gas treatment section for separating light olefins (ethylene, propylene) from other gases: hydrogen, methane, ethane, propane. This separation section is represented by the assembly formed by fractionation of the effluents, FRAC, and the cold box for separating light compounds (i.e. containing less than 5 carbon atoms), denoted SBF.

This assembly of the fractionation unit, which is well known to the skilled person, will not be described in detail.

The heaviest portion of the hydrocarbon effluents is processed in a separation section, FRAC, comprising at least one fractionation unit for recovering the $C_6$+ cut (stream 7) which is sent to the aromatics complex (CA).

The intermediate portion comprising the hydrocarbons containing 4 or 5 carbon atoms may either be recycled directly to the NCC or be sent to an oligomerization unit OLG in order to obtain poly $C_4/C_5$ type cuts the cracking capability (i.e. cracking potential) of which in the NCC is substantially higher than that of non-oligomerized compounds, or it may be upgraded into dedicated pools.

The NCC unit is preferably operated under high severity conditions, i.e. at a high reactor outlet temperature (ROT) and with a high C/O ratio (ratio of the flow rate of catalyst to the flow rate of feed entering the NCC, the two flow rates being mass flow rates).

The range of operating conditions is given in Table 1 below.

TABLE 1

| Range of operating conditions in the FCC (NCC) unit | | |
|---|---|---|
| Condition | Min | Max |
| ROT, ° C. | 500 | 750 |
| C/O | 5 | 40 |

The catalyst may be any type of acid catalyst, preferably a catalyst containing a certain proportion of zeolite, preferably more than 20% of the total catalyst mass.

A typical FCC catalyst comprising alumina, Y zeolite and ZSM-5 zeolite is an example of a catalyst which may be used.

EXAMPLES IN ACCORDANCE WITH THE INVENTION

Laboratory tests on a unit simulating NCC were carried out on a highly paraffinic light naphtha cut, on a light cut removed from the outlet from the catalytic reforming unit and on an aromatic cut which was representative of a stream termed "heavy aromatics" (denoted HA) originating from the aromatics complex.

The tests were carried out under high severity conditions (temperature >650° C. and C/O>15) in order to simulate the operating conditions of the NCC as closely as possible.

These tests could be used to establish the yield structures for cracking a NCC feed.

For naphtha reforming, severe conditions were employed, meaning that a RON of about 95 was obtained.

Example 1

FCC Unit for Naphtha (in Accordance with the Prior Art)

The first example is used to justify the interest in the proximity of the aromatics complex and the NCC unit in order to extract the aromatics produced during cracking of a straight run gasoline type feed.

Table 2 below describes the structure, by chemical family, of a paraffinic naphtha with a distillation range in the range 55° C. to 115° C.

Table 3 below provides the yield structure of the products obtained from cracking this feed on a simulated riser mode pilot unit with a short contact time and under high severity conditions.

TABLE 2

| Composition of naphtha FCC by hydrocarbon family | |
|---|---|
| | Composition (% by wt) |
| n-paraffins | 28.10 |
| i-paraffins | 29.98 |
| Naphthenes | 33.67 |
| Olefins | 1.03 |
| Di-olefins | 0.13 |
| Aromatics | 7.08 |

Cracking this high severity naphtha (T=650° C., C/O=15) produced the following yields by weight for the molecules of interest in our case:

TABLE 3

| Principal cracking yields | |
|---|---|
| | Yield (% by wt) |
| Ethylene | 12.63 |
| Propylene | 18.01 |
| Butenes | 8.51 |
| $C_6$ aromatic | 4.31 |
| $C_7$ aromatic | 7.13 |
| $C_8$ aromatic | 2.25 |
| Coke | 0.14 |

The ethylene and propylene yields were much higher than with a conventional VGO FCC. In contrast, the coke yield was much lower than for conventional FCC. With this lower coke yield, an external supply of heat to the regenerator was necessary; it represented as much as 95% of the heat necessary to ensure an equilibrium between the reactor and the regenerator.

For a naphtha feed flow rate (Table 2) of 5000 tonne/hour, the flow rates of the various cracking effluents are given in Table 4 below.

TABLE 4

| Flow rates of principal compounds of NCC for a capacity of 5000 tonne/hour. | |
|---|---|
| | Flow rate (tonne/hour) |
| Ethylene | 631 |
| Propylene | 900 |
| Butenes | 426 |
| $C_6$ aromatic | 215 |
| $C_7$ aromatic | 357 |
| $C_8$ aromatic | 112 |
| Coke | 7 |

Example 2

NCC Unit Coupled with an Aromatics Complex with Broad Naphtha Cut, 50-50 Split In order to illustrate the advantages of the present invention, we considered a total naphtha with an initial point of 55° C. and an end point of 160° C.

The distilled fraction corresponding to the first 50% by weight and with the properties given in Table 2 was sent to the NCC under the severity conditions described in Example 1, while the 115° C.+ portion, representing approximately 50% by weight in total, was sent to a catalytic reforming unit.

The effluents from the two units were arranged as described in FIG. 1 of the invention.

The flow rates leaving the NCC units and the aromatics complex (CA) for a total flow rate of naphtha of 10000 tonne/hour are given in Table 5 below.

TABLE 5

| Flow rates of principal compounds of NCC + aromatics complex for a capacity of 10000 tonne/hour (5000 tonne/hour NCC, and 5000 tonne/hour for reforming) | |
|---|---|
| | Flow rate (tonne/hour) |
| Ethylene | 717 |
| Propylene | 1110 |
| Butenes | 515 |

TABLE 5-continued

| Flow rates of principal compounds of NCC + aromatics complex for a capacity of 10000 tonne/hour (5000 tonne/hour NCC, and 5000 tonne/hour for reforming) | |
|---|---|
| | Flow rate (tonne/hour) |
| $C_6$ aromatic | 674 |
| $C_7$ aromatic | 1382 |
| $C_8$ aromatic | 1199 |
| Coke | 98 |

Compared with the situation of Example 1 (cracking naphtha alone), the flow rates for the light olefins were substantially improved:

ethylene increased from 631 to 717 tonne/hour;

propylene increased from 900 to 1110 tonne/hour;

butenes increased from 426 to 674 tonne/hour.

In the case of the NCC coke yield, this was very substantially increased.

It went from 7 to 98 tonne/hour. This coke yield almost balanced the thermal balance of the NCC, since it went from 95% of the thermal cycling supplied by an external source to the regenerator to only 17%.

Example 3

NCC Unit Coupled with an Aromatics Complex with Broad Naphtha Cut, 40-60 Split

In the case in which a thermal balance is to be established for the NCC and the aromatics production is to be increased, 40% of the total naphtha (55° C.-160° C.) can be sent to the NCC unit and the remaining 60% to the reforming unit (REF).

The outlet flow rates were thus as follows:

TABLE 6

| Flow rates of principal compounds of NCC + aromatics complex for a capacity of 10000 tonne/hour (4000 tonne/hour NCC, and 6000 tonne/hour for reforming) | |
|---|---|
| | Flow rate (tonne/hour) |
| Ethylene | 608 |
| Propylene | 972 |
| Butenes | 447 |
| $C_6$ aromatic | 723 |
| $C_7$ aromatic | 1516 |
| $C_8$ aromatic | 1394 |
| Coke | 115 |

The yield of light olefins (ethylene, propylene, butenes) fell compared with the preceding case (Table 5), but remained higher than in the case of NCC alone (Table 4), except for the ethylene, where there was a slight fall.

The aromatics yields were substantially increased due to the fact that more feed had been sent for reforming and to the aromatics complex. The NCC coke continued to increase, since more heavy aromatics were sent to the reactor.

With the coke yield obtained, the thermal balance of the NCC cycled without the need for an external heat source, which represents a very appreciable advantage from the point of view of the operating costs of the process.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding French Application No. 14/53076, filed Apr. 7, 2014 are incorporated by reference herein.

The invention claimed is:

1. A process for the production of light olefins and BTX starting from a naphtha cut with an initial boiling point of more than 30° C. and a final boiling point of less than 220° C., said process comprising a catalytic cracking unit (NCC) processing a light naphtha type feed (30-$T_M$° C.), a catalytic reforming unit (REF) processing a feed termed a heavy naphtha ($T_M$° C.-220° C.), and an aromatics complex (CA) supplied with effluents from catalytic reforming (REF) and the 60+ fraction of the NCC effluents, said process comprising the following series of operations:

sending a naphtha feed (1) with an initial boiling point of at least 30° C. and a final boiling point of at least 220° C. to a hydrotreatment unit (HDT) which can eliminate the sulphur-containing and nitrogen-containing compounds it contains;

sending the hydrotreated naphtha feed (2) to a separation unit (SPLIT1) which can separate a light naphtha fraction, with a distillation range of 40° C.-$T_M$° C., and a heavy naphtha fraction with a distillation range of $T_M$° C.-220° C., in which $T_M$° C. is in the range 80° C. to 160° C., sending the light naphtha fraction (3) to the NCC as a feed;

sending the heavy naphtha (4) as a feed for the catalytic reforming unit (REF);

separating the effluents (6) from the NCC in a fractionation unit (FRAC) which can separate a light fraction (8) which is sent to a separation termed the cold box separation, (SBF), which can isolate $H_2$, $CH_4$ and the $C_2$, $C_3$ and $C_4$ light parafins from ethylene and propylene;

sending the heavy fraction (7) obtained from the separator (FRAC) as a mixture with the effluents 5 from the catalytic reforming REF as a feed 10 for the aromatics complex AC;

from the aromatics complex (CA), extracting the BTX compounds, a raffinate (12), defined as the non-aromatic portion of the effluents, at least a portion of which is sent as a mixture with the light naphtha (3) as a feed for the NCC, and a heavy aromatics stream (11) which is also sent as a mixture with the light naphtha (3) as a feed for the NCC.

2. A process for the production of light olefins and BTX starting from a catalytic cracking unit (NCC) processing a light naphtha type feed (30-$T_M$° C.), a catalytic reforming unit (REF) processing a feed termed a heavy naphtha ($T_M$° C.-220° C.), and an aromatics complex (CA) supplied with effluents from catalytic reforming (REF) and the 60+ fraction of the NCC effluents according to claim 1, in which the raffinate effluent 12 from the aromatics complex is sent to a separation unit (SPLIT2) which can separate a light fraction (13) which is sent, as a mixture with the light naphtha feed (3), to the catalytic cracking unit (NCC), and a heavy fraction (14) which is sent, as a mixture with the heavy naphtha feed (4), to the catalytic reforming unit (REF).

3. A process for the production of light olefins and BTX starting from a catalytic cracking unit (NCC) according to claim 2, in which the light $C_2$ to $C_5$ paraffins produced as effluents from the catalytic cracking unit (NCC) originating from the separation box (BF) are sent to the catalytic cracking unit NCC as a mixture with the light naphtha feed (3).

4. A process for the production of light olefins and BTX starting from a catalytic cracking unit (NCC) according to claim 3, in which the light $C_4$ and $C_5$ olefins are sent to an oligomerization unit (OLG) and the effluents from said oligomerization unit OLG are sent to the catalytic cracking unit NCC as a mixture with the light naphtha feed (3).

5. A process for the production of light olefins and BTX starting from a catalytic cracking unit (NCC) processing a light naphtha feed (30-$T_M$° C.), a catalytic reforming unit (REF) processing a feed termed a heavy naphtha ($T_M$° C.-220° C.), and an aromatics complex (CA) supplied with effluents from the catalytic reforming unit and the 60+ fraction of the NCC effluents according to claim 1, in which the light naphtha cut (3) obtained from fractionation (SPLIT1) is preheated in the convection zone for the catalytic reforming furnaces (FREF) before being introduced as a feed to the catalytic cracking unit (NCC).

6. A process for the production of light olefins and BTX starting from a catalytic cracking unit (NCC) according to claim 1, in which the operating conditions for the NCC are as follows: reactor outlet temperature in the range 500° C. to 750° C., and ratio of the mass flow rate of catalyst to the mass flow rate of feed (C/O) in the range 5 to 40.

7. A process for the production of light olefins and BTX starting from a catalytic cracking unit (NCC) according to claim 1, in which the catalyst used in the NCC unit comprises a proportion of ZSM-5 zeolite equal to at least 10% by weight with respect to the total catalyst.

8. The process of claim 1 wherein the $T_M$° C. is in the range of 100° C. to 150° C.

9. The process of claim 1 wherein the $T_M$° C. is in the range of 110° C. to 140° C.

* * * * *